US005379676A

United States Patent [19]

Profeta et al.

[11] Patent Number: 5,379,676

[45] Date of Patent: Jan. 10, 1995

[54] FIRE CONTROL SYSTEM

[75] Inventors: Joseph A. Profeta, Gibsonia, Pa.; F. Lowell Avent, Rockwall, Tex.

[73] Assignee: Contraves USA, Pittsburgh, Pa.

[21] Appl. No.: 42,718

[22] Filed: Apr. 5, 1993

[51] Int. Cl.[6] ..... F41G 3/02

[52] U.S. Cl. ..... 89/41.05; 89/41.06; 89/41.07; 89/41.19

[58] Field of Search ..... 89/41.01, 41.05, 41.06, 89/41.07, 41.08, 41.14, 41.15, 41.17, 41.19, 41.21, 41.22

[56] References Cited

U.S. PATENT DOCUMENTS

| | | | |
|---|---|---|---|
| 3,339,457 | 9/1967 | Pun | 89/41.06 |
| 3,659,494 | 5/1972 | Philbrick et al. | 89/41.17 |
| 3,845,276 | 10/1974 | Kendy et al. | 89/41.06 |
| 4,266,463 | 5/1981 | Saltin | 89/41.06 |
| 4,370,914 | 2/1983 | Voles | 89/41.05 |
| 4,787,291 | 11/1988 | Frohock, Jr. | 89/41.22 |
| 4,878,752 | 11/1989 | Bramley | 89/41.06 |
| 4,922,801 | 5/1990 | Jaquard et al. | 89/41.05 |

FOREIGN PATENT DOCUMENTS

| | | | |
|---|---|---|---|
| 10480 | 4/1980 | European Pat. Off. | 89/41.22 |
| 218742 | 4/1987 | European Pat. Off. | 89/41.17 |
| 1336051 | 7/1963 | France | 89/41.05 |

*Primary Examiner*—Stephen C. Bentley
*Attorney, Agent, or Firm*—Ansel M. Schwartz

[57] ABSTRACT

The present invention is a fire control system. The fire control system comprises a manually aimed gun having a sighting device and a device for acquiring a target. The acquiring device is disposed at a location remote from the gun. The fire control system also comprises a device for providing information relating to the target to the sighting device of the gun such that an operator of the gun can aim the gun with respect to the sighting device. The providing device is in communication with the acquiring device and the sighting device. The present invention is also a fire control method for a minor caliber gun. The method comprises the step of acquiring a target from a location which is remote from the gun. Next, there is the step of providing information relating to the target to a sighting device of the gun. Then, there is the step of manually aiming the gun in accordance with the information appearing on the sighting device.

18 Claims, 10 Drawing Sheets

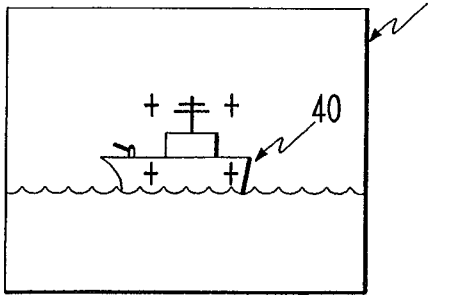
FIG. 4a
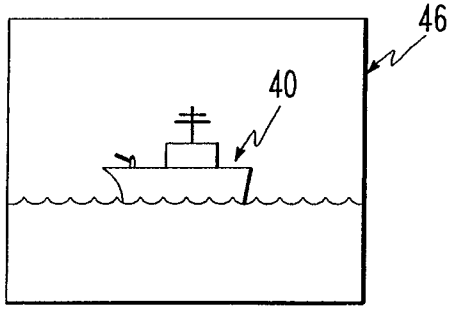
FIG. 4b
FIG. 4c
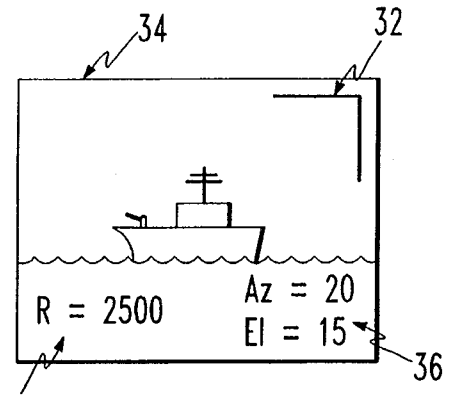
FIG. 4d
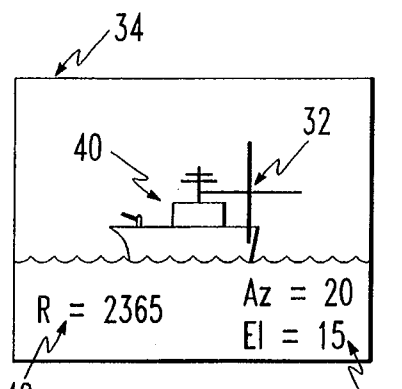
FIG. 4e
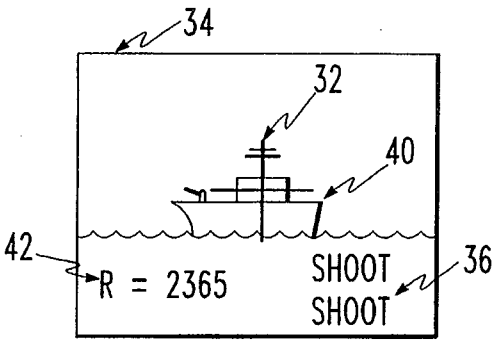
FIG. 4f

FIRE CONTROL SYSTEM

FIELD OF THE INVENTION

The present invention is related in general to fire control systems. More specifically, the present invention is related to a fire control system for a manually aimed minor caliber gun.

BACKGROUND OF THE INVENTION

Historically, minor caliber (<40 mm) weapon stations have been crew-operated with the crew providing both manual weapon movement and aiming. Sights generally were little more than iron reticles with gunnery limited by visual conditions. Such small caliber weapon stations offered no night capability and had limitations imposed by inclement weather such as smoke and fog, frequent conditions found in operational situations.

Recent advancements in day/night sights, laser ranging, stabilization, target acquisition and tracking and digital processing have led to a new generation of highly accurate weapon stations. These new weapon stations are capable of accurate target engagements twenty-four hours a day, even while being subjected to disturbances such as vibration and movement. While these performance improvements have been impressive, there has been a price to pay. That price has been an evolution toward remotely operated weapon stations with a significant increase in weight and complexity (cost). A typical control sequence for a remotely operated motorized weapon is shown in FIG. 5. In remotely operated weapon systems, target acquisition data, such as infrared imaging, laser ranging and stabilization are used to directly control a mechanical positioning device to automatically aim the gun. Because of the complexity and cost of modern fire control systems, they have not been used with minor caliber manually aimed guns. Since modern warfare is now dependent on twenty-four hour capability while providing superior fire control accuracy, it is necessary to develop a manually aimed gun having access to the sophisticated fire control technology of many remotely operated weapon stations.

The present invention utilizes modern fire control technology and provides (both day AND night) for manually aimed weapon stations.

SUMMARY OF THE INVENTION

The present invention is a fire control system. The fire control system comprises a manually aimed gun having a sighting device. The system also comprises means for acquiring a target. The acquiring means is disposed at a location remote from the gun. The fire control system also comprises means for providing information relating to the target to the sighting device of the gun. The providing means is in communication with the acquiring device and the sighting device.

Preferably, the acquiring device comprises a visual imaging means such as a radar device and an electro-optical tracker device having a FLIR imaging device and a laser rangefinder, and a computer console for positioning the visual imaging means. The acquiring devices can also comprise a day TV camera device.

The present invention is also a fire control method for a minor caliber gun. The method comprises the step of acquiring a target from a location which is remote from the gun. Next, there is the step of providing information relating to the target to a sighting device of the gun. Then, there is the step of manually aiming the gun in accordance with the information appearing on the sighting device.

BRIEF DESCRIPTION OF THE DRAWINGS

In the accompanying drawings, the preferred embodiment of the invention and preferred methods of practicing the invention are illustrated in which:

FIGS. 4*a*–4*f* are schematic representations showing the control video monitor and the video monitor of the gun.

DESCRIPTION OF THE PREFERRED EMBODIMENT

Figure 1:
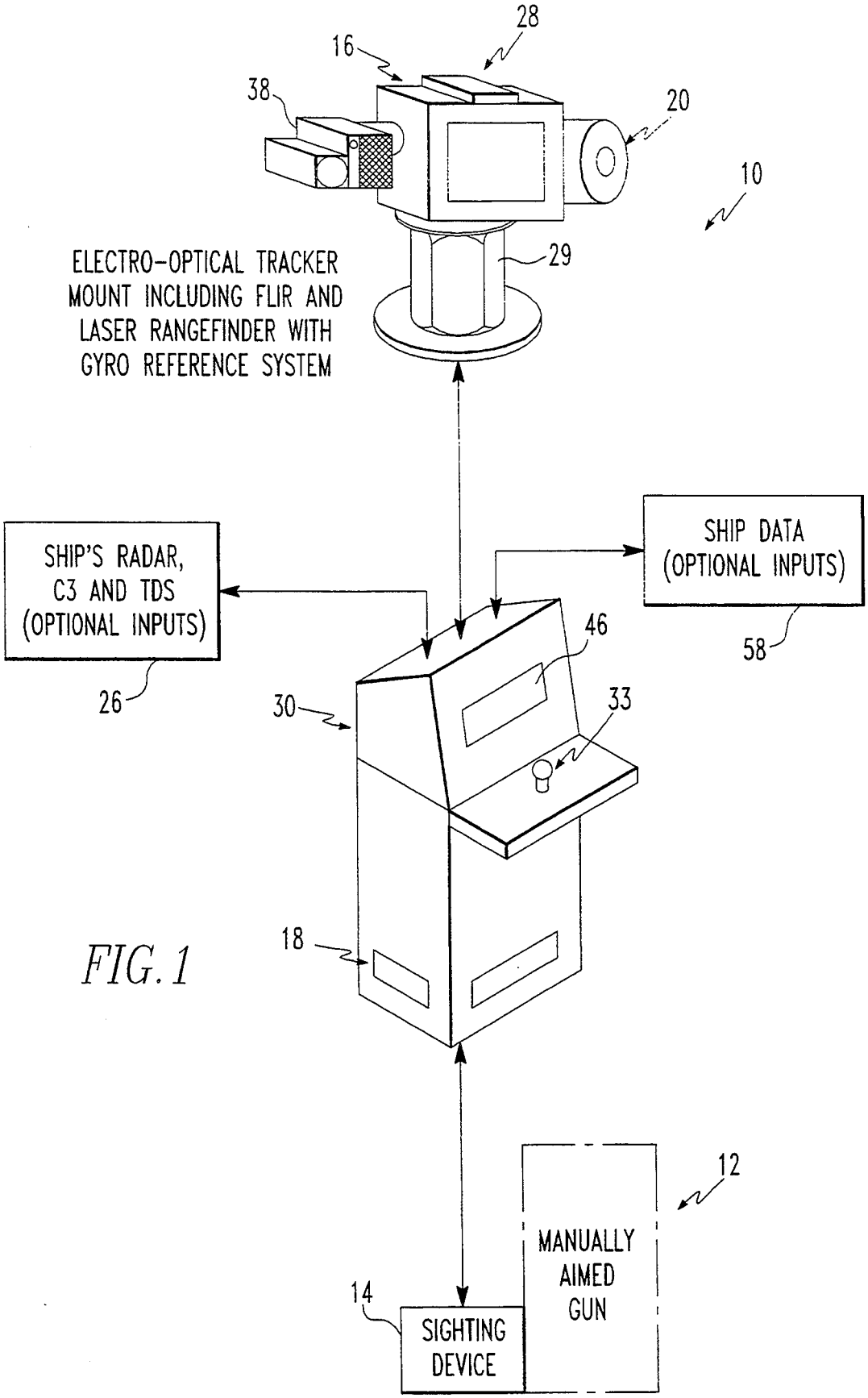
FIG. 1 is a schematic representation of the fire control system.

Referring now to the drawings wherein like reference numerals refer to similar or identical parts throughout the several views, and more specifically to FIG. 1 thereof, there is shown a fire control system 10. The fire control system 10 comprises a manually aimed gun 12 having a sighting device 14. The fire control system 10 also comprises means 16 for acquiring a target. The acquiring means 16 is preferably disposed at a location remote from the gun 12. The fire control system 10 also comprises means 18 for providing information relating to the target to the sighting device 14 of the gun 12 such that an operator of the gun 12 can aim the gun 12 with respect to the sighting device 14. The providing means 18 is in communication with the acquiring means 16 and the sighting device 14.

Figure 2:
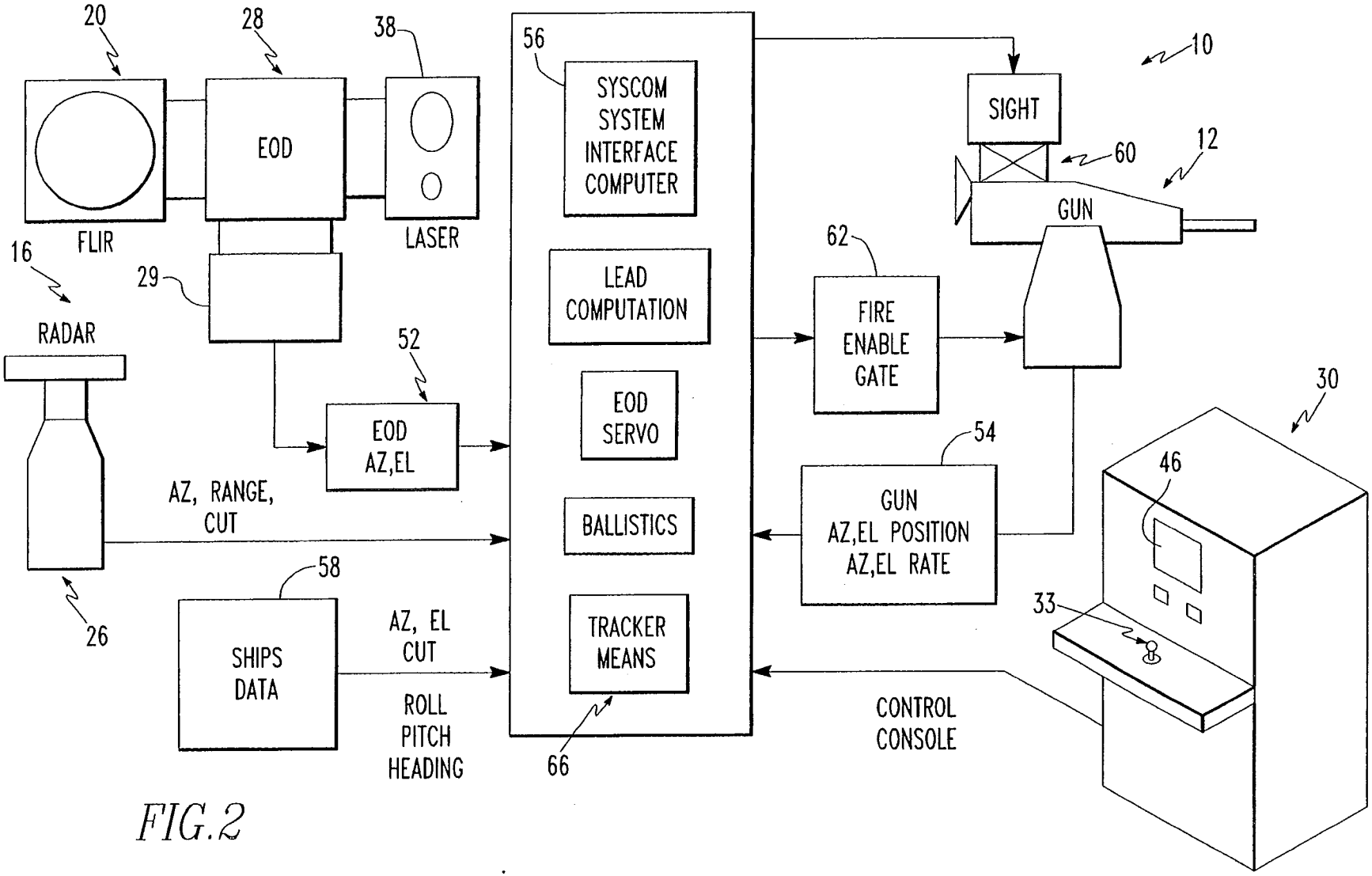
FIG. 2 is a schematic representation of the fire control system.

Preferably, the target trajectory providing means 18 comprises means 66 for tracking the target, as shown in FIG. 2. This allows the operator of the gun 12 to manually aim the gun 12 using information which was gathered at a location remote from the gun 12 and displayed on the gun's sighting device 14. In this manner, a minor caliber gun (less than 40 mm), such as a BMARC 20 mm gun, can have access to, for instance, the advanced target acquisition, imaging and tracking systems which are disposed on board many modern naval vessels and which were previously used only for the automatic control of large caliber guns and missile systems such as the Contraves LSEOS Mark II Lightweight Shipboard Electro-Optic System.

In one embodiment of the invention, the acquiring means 16 comprises an infrared imaging device, or FLIR device 20 which locates a target based on the heat it produces. The FLIR device 20 produces a signal corresponding to the position of the target and provides the signal to the providing means 18. The providing means 18 provides infrared images based on the signal from the FLIR device 20 to the sighting device 14 of the gun 12 such that an operator of the gun 12 can manually aim the gun 12 in poor vision conditions, such as at night or in fog or through smoke. Furthermore, the FLIR device 20 provides the gunner with the ability to perform day and night surveillance operations.

As shown in FIGS. 4c–4f, the trajectory information of the target is provided to the sighting device 14 of the gun 12 with a reticle 32. The providing means 18 can also supply direction of motion symbology 36 to the sighting device 14 based on the direction and magnitude required to correctly aim the gun 12 so that where the gun 12 is pointing is what will appear as the reticle on the monitor and where the gun will fire upon. The direction of motion symbology 36 can be used by the gunner to move the gun 12 towards the position of the target acquired by the acquiring means. The providing means 18 can also provide range data 42 to the sighting device 14. Preferably, the sighting device 14 comprises a video display monitor 34.

Figure 3A:
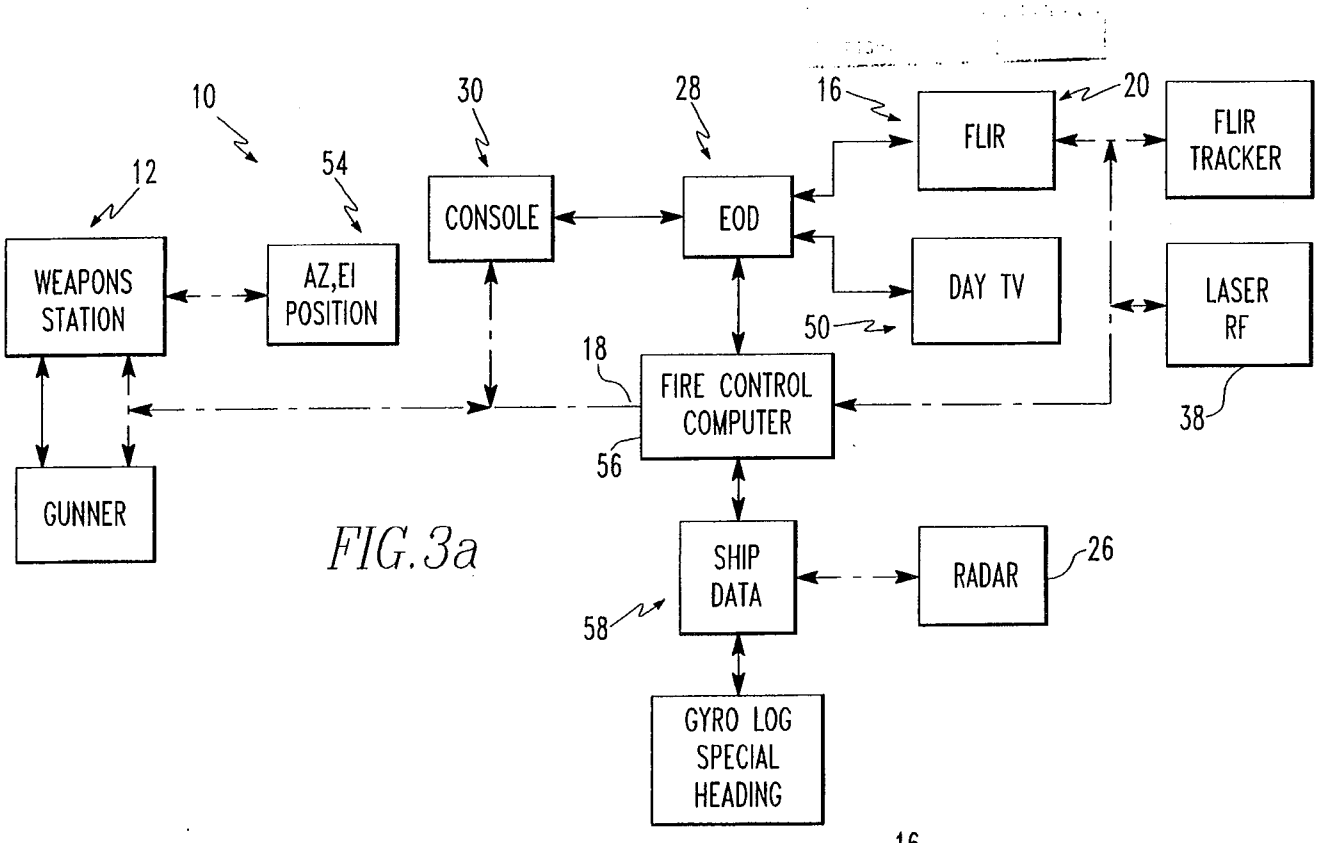
FIGS. 3*a* and 3*b* are block diagram representations of the fire control system.

The target acquisition means 16 preferably comprises a radar device 26 and an electro-optical device (EOD) 28 which is rotatably mounted on a pedestal 29 and which is controlled remotely, such as from a control console 30 having a joystick 33 and a control display screen 46, as shown in FIG. 2. The electro-optical device 28 is used to obtain more detailed acquisition information of the target identified by the radar device 26 or by a target designation site (TDS). The electro-optical device 28 preferably has an FLIR imaging device 20 and a laser rangefinder device 38. Examples of commercially available FLIR imaging devices 20 are Kollsman's AN/TAS-4B, Pilkington's HPS 2000/N, Brunswicks' AN/KAS-1 or Texas Instruments TILSEOS. Examples of commercially available eyesafe laser rangefinders 38 are Laser Atlanta's A7000 or A10000, Varo's (IMO) ER ESLR, Litton's SL-4/10 or SL-4/ES, EOS of Australia's ESLR or Hughes MI laser. Preferably, the laser rangefinder 38 provides a pulse of laser light at least every two seconds. If a specific target engagement scenario is deemed an overriding concern, faster pulse rates for short engagement periods can be accommodated. As shown in FIG. 3a, the electro-optical device 28 can also comprise a conventional day TV 50 which operates at a different spectral energy band than the FLIR 20. The radar device 26, in typical situations, initially acquires the target by displaying a blip on a radar screen of the radar device 26. The radar can be an active or passive radar.

The following represents specifications for an FLIR device 20 having high resolution and sensitivity.

| | |
|---|---|
| System Magnification | 3x/12x |
| Wide FOV | 8 deg × 12 deg |
| Narrow FOV | 2 × 3 |
| IFOV Narrow FOV | 0.12 mrad |
| Detector Type | 8 BAR Sprite |
| Cooler Type | Joule Thompson |

In order to sense the position of the electro-optical device 28, the providing means 18 preferably also comprises means 52 for sensing the position and movement of the electro-optical device 28 with respect to a predetermined reference system, as shown in FIG. 2. For instance, the sensing means 52 can comprise a conventional T-shaft transducer mounted on the pedestal 29 which provides signals representing the azimuth and elevation of the electro-optical device 28. In order to sense the position of the gun 12, the providing means 18 also comprises means 54 for sensing the position and movement of the gun 12 with respect to a predetermined reference system. The gun sensing means 54 preferably provides signals representing the guns azimuth and elevation and rate of change to the providing means 18. The gun sensing means 54 can be a conventional encoder or transducer for such purposes.

Preferably, the providing means 18 comprises a computer 56. The computer 56 utilizes azimuth and elevation data from the position sensing means 52, 54 of the electro-optical device 28 and gun 12, respectively, and target range data from the laser RF 38 to provide target information to the sighting device 14. Preferably, the computer 36 is a SYSCOM computer 56.

In order to obtain increased ballistic accuracy, the providing means 18 can also comprise a stabilization device, such as a Honeywell or Litton Gyro System, for allowing the operator of the gun 12 to aim the gun during conditions of instability. Preferably, the providing means 18 comprises means 58 for supplying data from a vehicle, such as a ship, upon which the fire control system 10 is mounted. The data can include information such as the ships azimuth, elevation, cut, pitch, roll and heading which can be obtained by well known techniques.

If desired, the computer 56 can generate graphics of backgrounds and targets which can be displayed on the video display monitor 34 of the gun 12. This feature allows for gunner training and scoring which improves gunner proficiency and accuracy while reducing average firing times.

The present invention is also a fire control method for a minor caliber gun 12. The method comprises the steps of acquiring a target from a location which is remote from the gun 12. Next, there is the step of providing information relating to the target to a sighting device 14 of the gun 12. Next, there is the step of manually aiming the gun 12 in accordance with the information appearing on the sighting device 14.

Preferably, the providing step includes the step of providing an FLIR image of the target on the video display monitor 34 and after the providing step, there is the step of firing the gun 12.

Figure 3B:
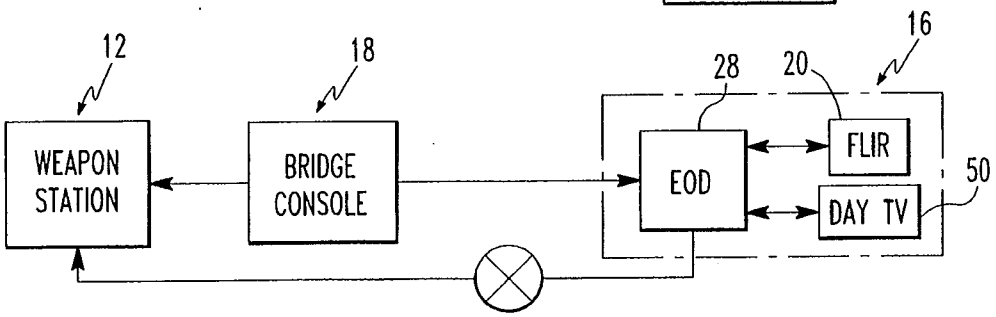

As shown in FIG. 3b, the electro-optical device 28 provides information to the sighting device 14 without trajectory information. A gunner then aims and fires the gun based on what he sees in the monitor 34 such as an FLIR image of the target. In this case, the monitor may allow the gunner to see what he otherwise could not.

In the operation of one embodiment of the invention, the fire control system 10 is disposed on a ship such as a military vessel. The gun 12 is a 20 mm BMARC GAM gun and is mounted on the ship's deck. For purpose of description, it will be assumed that the ship is patrolling waters having enemy ships in poor visibility conditions, such as at night.

Initial acquisition of a target 40 is typically accomplished with the ship's radar system 26 and a target management system (TMS), as is well known in the art. In order to identify the target, the electro-optical device 28 is activated to locate the target 40 in a wide field of view which is shown on the control video monitor 46 of the control console 44, as shown in FIG. 4a. The control console 30 is located within the interior of the ship. Once the target 40 is located with the electro-optical device 28 in the wide field of view mode, the target 40 is more accurately identified by switching to a narrow field of view as shown in FIG. 4b. The FLIR device 20 provides an infrared image of the target 40 to the control video monitor 46 of the control console 30. An operator of the control console 30 controls movement of the electro-optical device 28 with joystick 33. At this point, the video display monitor 34 of the gun 12 can also be provided with an infrared image of the target 40 so that the gunner can see the target 40. The gunner can simply use the infrared image to see the target and mentally approximate a ballistic solution.

The computer 56 provides a RS170 video signal to the video display monitor 34. The gunner then moves the gun 12 towards the target using the direction of motion symbology 36 which changes with respect to the gun's movement. The reticle 32 converges on the target 40 nonlinearly, as shown in FIG. 4*e*. When the reticle 32 is positioned on the target, the direction of motion symbology 36 spells "SHOOT" in the azimuth and elevation positions.

Figure 5:
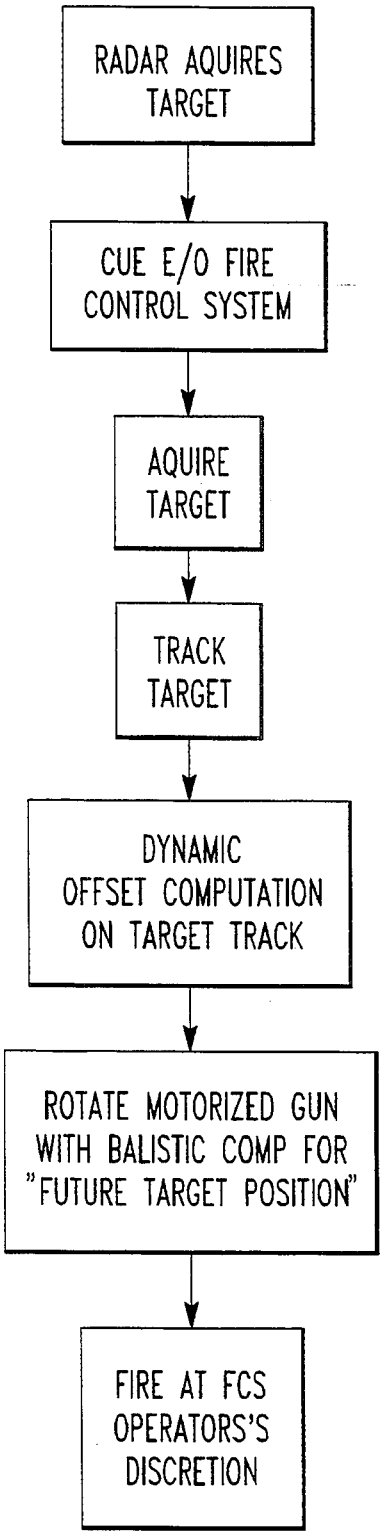
FIG. 5 PRIOR ART
FIG. 5 is a flow chart of the steps related with a prior art fire control system.
Figure 6A:
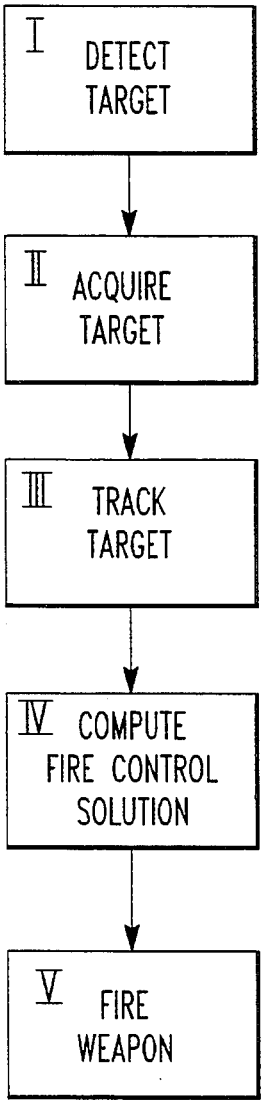
FIGS. 6*a*–6*e* are flow charts representing the steps related to the fire control system.
Figure 6B:
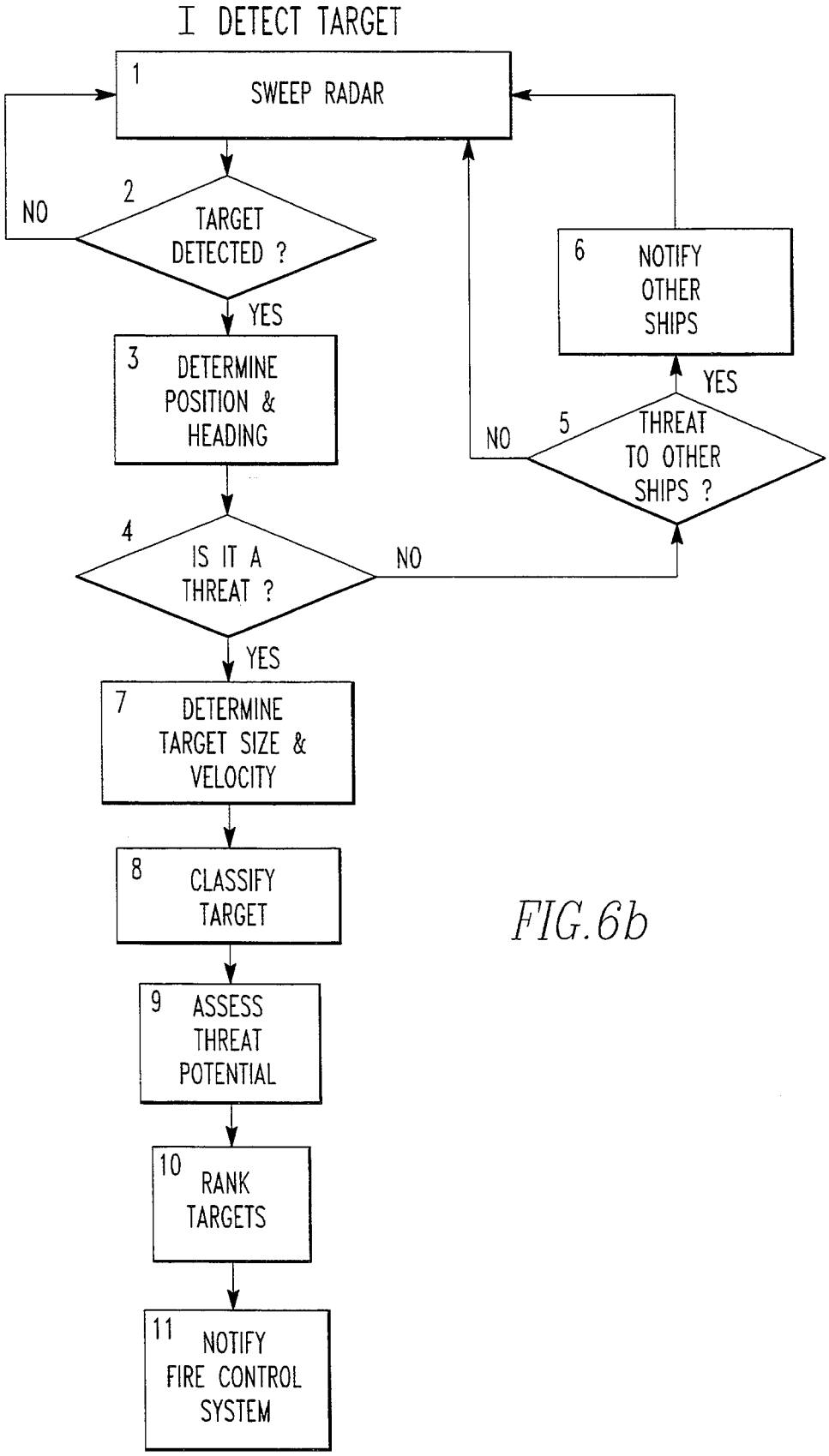
Figure 6C:
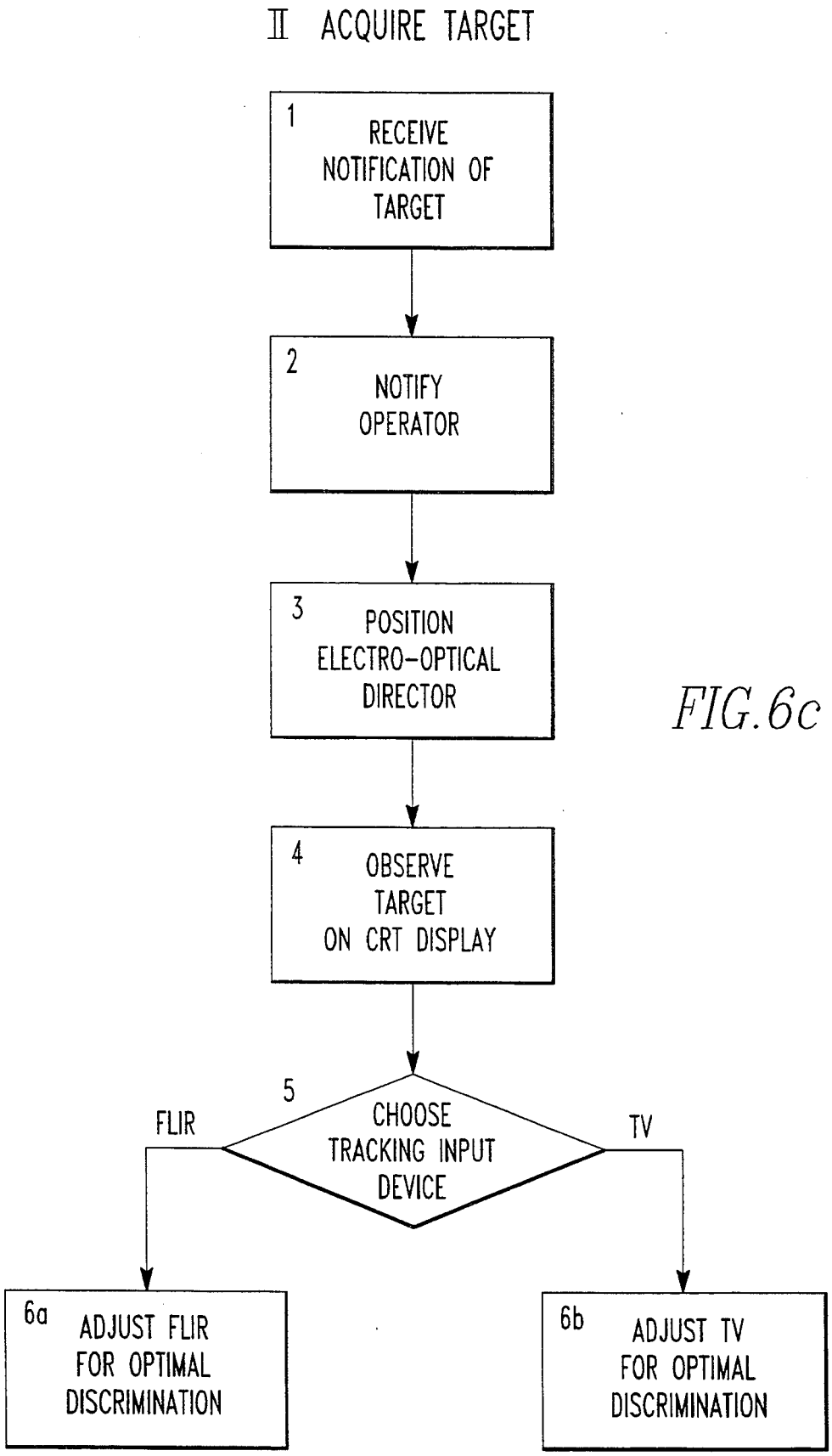
Figure 6D:
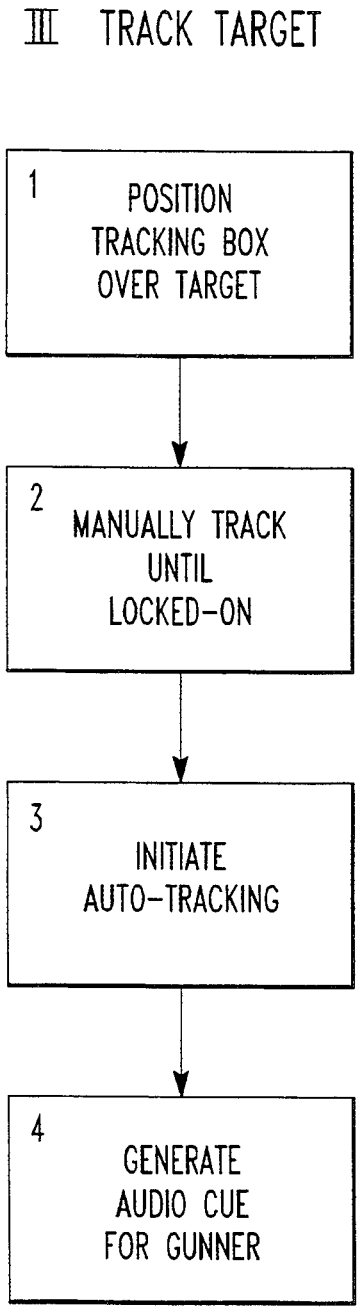
Figure 6E:
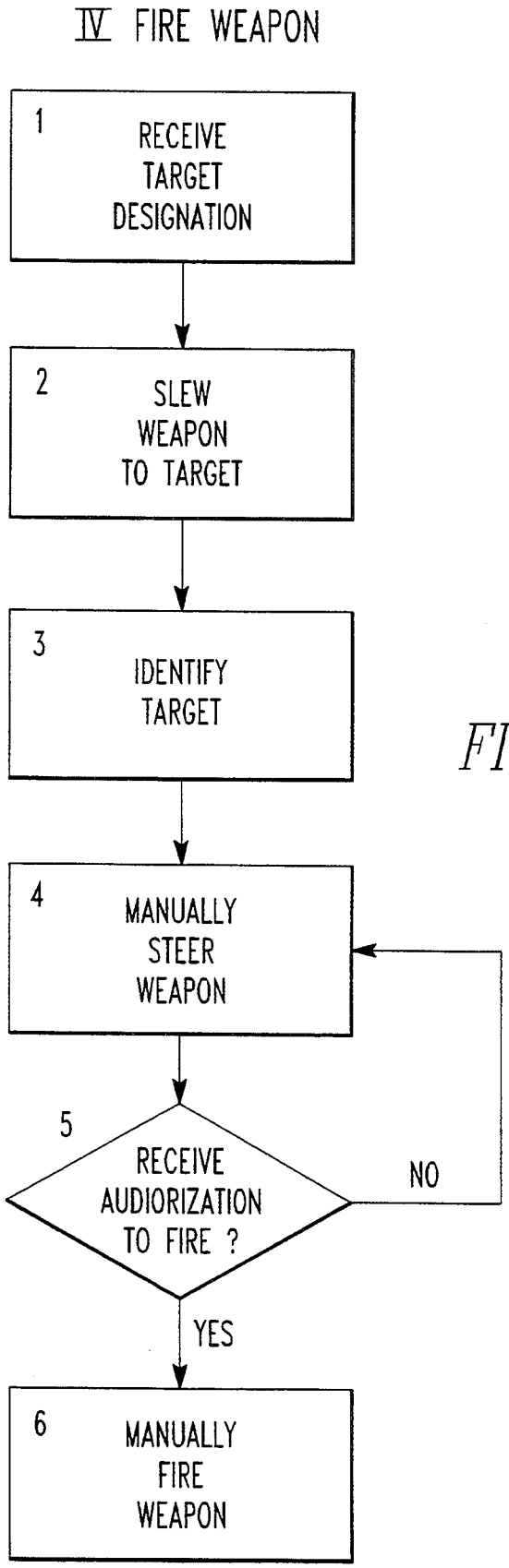

A summary of the fire control method of the present invention is shown in FIGS. 6*a*–6*f*. As a comparison, FIG. 5 shows a prior art fire control method. In the prior art, a ballistic computation is determined and is used to directly control the motion of the gun. This stands in contrast to the present invention which does not mechanically steer the gun but provides target information to the gunner in order for the gunner to manually aim the gun. In this manner, small caliber guns can take advantage of the advanced imaging techniques which were previously used only to control large caliber guns and missile systems.

The following represents a summary of the steps illustrated in FIGS. 6*a*–6*e*.

I. DETECT TARGET

I.1 Sweep Radar. Radar is sweeping continuously in order to locate targets.

I.2 Target Detected? The target is initially detected when a spot is observed on the PPI.

I.3 Determine Position & Heading. The target's position is observed directly from radar. Its heading is determined by measuring the change in position on successive radar sweeps.

I.4 Is It a Threat? At this point, determination of threat is based on the target's heading. If it is headed toward the ship, it is deemed a threat, otherwise, not.

I.5 Threat to Other Ships? The determination of threat to other ships in the fleet is, once again, based on the target's heading.

I.6 Notify Other Ships. The operator contacts other ships, deemed to be at risk, of the threatening target.

I.7 Determine Target Size & Velocity. Target size is determined by observing the size of the spots representing the targets. Target velocity is determined by measuring changes in target position on successive radar sweeps.

I.8 Classify Target. Targets are classified by size and velocity as either airplanes, missiles, helicopters or ships, according to the following table:

| | Airplane | Missile | Helicopter | Ship |
|---|---|---|---|---|
| Size | .7 PU | .1 PU | .5 PU | 1 PU |
| Velocity | .7 PU | 1 PU | .5 PU | .1 PU |

I.9 Assess Threat Potential. Evaluate threat based on target classification, position and heading.

I.10 Rank Targets. When all targets have been evaluated in terms of threat potential, they are ranked in order of decreasing threat.

I.11 Notify Fire Control System. The fire control system is notified of the most threatening target in terms of target classification, position and velocity.

II. ACQUIRE TARGET

II.1 Receive Notification of Target. The fire control system is notified by the Target Management System of the classification, position and velocity of the most threatening target.

II.2 Notify Operator. The operator is notified by means of output devices on the Operator Control Console (OCC).

II.3 Position Electro-Optical Director. The azimuth and elevation axes of the EOD are rotated to point the FLIR and laser rangefinder toward the target.

II.4 Observe Target on CRT. The FLIR or TV image of the target is displayed on an OCC CRT display, allowing target recognition.

II.5 Choose Tracking Input Device. Operator chooses between FLIR tracking and TV tracking depending on environmental conditions and target characteristics.

II.6*a* Adjust FLIR For Optimal Discrimination. The operator adjusts FLIR controls, including level and field of view, to optimize target discrimination.

II.6*b* Adjust TV For Optimal Discrimination. The operator adjusts TV controls to optimize target discrimination.

III. TRACK TARGET

III.1 Position Tracking Box Over Target. By manipulating the controls on the OCC, the operator moves the tracking symbol over CRT image of the target to begin tracking.

III.2 Manually Track Until Locked-On. The user follows the target by manually positioning the tracking box over the CRT image until the system locks onto it.

III.3 Initiate Auto-Tracking. Once the system has locked onto the target, the operator initiates auto-tracking by pressing a button on the OCC.

III.4 Generate Audio Cue for Gunner. Gunner is alerted to the presence of a threat by means of an audio notification.

IV. FIRE WEAPON

IV. 1 Receive Target Designation. The gunner is notified of target designation by the bridge operator.

IV. 2 Slew Weapon to Target. The gunner rapidly steers his weapon into the vicinity of the target in order to engage.

IV. 3 Identify Target. The gunner observes the target on the weapon's integral monitor and makes an identification.

IV. 4 Manually Steer Weapon. The gunner manually steers the gun to keep the cross-hairs positioned over the target, as displayed on the monitor.

IV. 5 Receive Authorization to Fire? The gunner receives permission to fire on the target based on the actions of the bridge operator and weapons officers.

IV. 6 Fire Weapon. The gunner fires the weapon, keeping the cross-hairs positioned over the target, as displayed on the monitor.

A specific operational scenario for the Fire Control System 10 (FCS) for manned un-motorized 20 mm guns is as follows.

The target is detected by surface search radar, Target Designator Sight (TDS) or through the LSEOS MKIII operators console by operator manual operation or automatic search utilizing the monitor at the LSEOS MKIII operators console. The target can be a small patrol craft, helicopter, missile or fixed wing aircraft.

The detection range is a function of the target cross-sectional area (i.e., 3 square meters) for radar detection. In the case of FLIR detection, the thermal characteristics are the determining factor (i.e., 2 degrees C rise over the background). In the terms of the day video camera, a combination of cross-sectional area and target contrast are the determining factor.

After target detection of up to 20 km, the EOD will be slued to the target bearing and the operator performs a vertical scan either by automatic, semi-automatic or manual means by utilizing the joystick 33. As the vertical scan progresses, the operator observes the monitor 46 and decides upon the classification of the target. When the target comes into range of about 3 to 8 km and the operator RECOGNIZES the target as hostile (or conventional image identification software can be used), he manually moves the joystick 33 until the video tracking box is around the targets video image on the monitor and thus the automatic track of the target will have been initiated.

The target is automatically tracked by the video tracker and the laser on the EOD fired. Based on the return energy and transit time the range to the target is computed. The return range data will be combined with the azimuth and elevation data produced by the azimuth and elevation axis encoders which are on the EOD. The gun position is a known x1, y1, z1 relative to the EOD which is at a position of x2, y2, z2.

This azimuth, elevation and range data is used by the ballistic computer along with EOD and gun position as well as metrological data to target information to the gun 12.

The video image of the target is sent to the gunner's video monitor 14. Initially, the gunner probably does not have the target in the field of view in his monitor because there is no reason to assume he is pointing at the target. The monitor 14 has an indicator as to which way the gunner is to move his gun pedestal. When the operator has the target lined up with the gun 12, the operator can pull the trigger and the gun.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A fire control system comprising:

a manually aimed gun having a reticle;

means for acquiring a target, said acquiring means disposed at a location remote from that of said gun and independent of the reticle;

a video display monitor which displays an image of the target, said video display monitor adjacent the gun but independent from the reticle so a gunner can identify where a target is located from the image of the target displayed on the monitor and mentally approximate a ballistic solution in regard to the gun; and means for providing information relating to the target to the monitor said providing means in communication with said acquiring means and the monitor but independent of the reticle.

2. A fire control system as described in claim 1 wherein the acquiring means comprises visual imaging means and a control console for positioning the visual imaging means.

3. A fire control system as described in claim 2 wherein the visual imaging means comprises a day TV camera device.

4. A fire control system as described in claim 3 wherein the visual imaging means comprises an FLIR imaging device.

5. A fire control system as described in claim 4 wherein the acquiring means comprises a radar device.

6. A fire control system as described in claim 5 wherein the providing means comprises means for determining the position of the visual imaging means with respect to a predetermined reference system.

7. A fire control system as described in claim 6 wherein the providing means comprises means for determining the position of the gun with respect to a predetermined reference system.

8. A fire control system as described in claim 7 wherein the providing means provides information relating to the location of the target with respect to a predetermined reference system.

9. A fire control system as described in claim 8 wherein the providing means provides range data on the video display monitor.

10. A fire control system as described in claim 9 wherein the providing means comprises means for providing a FLIR image of the target to the video display monitor of the gun.

11. A fire control system as described in claim 10 wherein the control console has control video monitor.

12. A fire control system as described in claim 11 wherein the providing means comprises a computer.

13. A fire control system as described in claim 12 wherein the manually aimed gun has a caliber between 20 and 40 mm.

14. A fire control method for a minor caliber gun having a reticle comprising the steps of:

acquiring a target with an acquiring device which is at a location which is remote from that of the gun and independent of the reticle;

providing information relating to the target and acquired by the acquiring device to a video display monitor which displays an image of the target, salt video display monitor adjacent the gun but independent of the reticle;

locating the target relative to the gun by the gunner;

making a mental approximation by the gunner of a ballistic solution of the target in regard to the gun; and manually aiming the reticle of the gun in accordance with the mental approximation of the ballistic solution so the reticle is in a desired alignment with the target and the gun can shoot at the target when it is fired.

15. A method as described in claim 14 wherein the providing step includes the step of providing a FLIR image of the target acquired by the acquiring means on the sighting device.

16. A method as described in claim 15 wherein the providing step includes the step of providing a day TV image, acquired by the acquiring means, on the sighting device.

17. A method as described in claim 16 wherein the acquiring step includes the step of detecting a target with radar.

18. A method as described in claim 17 wherein after the aiming step, there is the step of firing the gun.

* * * * *